US007198151B1

(12) United States Patent
Fomby

(10) Patent No.: US 7,198,151 B1
(45) Date of Patent: Apr. 3, 2007

(54) ROPE CAN

(76) Inventor: Kenneth Alexander Fomby, 4450 W. Hwy. 82, P.O. Box 636, Gainesville, TX (US) 76240

( * ) Notice: Subject to any disclaimer, the term of this patent is extended or adjusted under 35 U.S.C. 154(b) by 0 days.

(21) Appl. No.: 11/231,573

(22) Filed: Sep. 20, 2005

(51) Int. Cl.
*B65D 85/00* (2006.01)
*B65D 6/28* (2006.01)

(52) U.S. Cl. ..... 206/403; 206/303; 220/4.24

(58) Field of Classification Search ..... 206/389, 206/403, 405, 53, 303, 493, 391, 388, 445, 206/446; 220/4.21–4.24, 4.25, 521, 500–506; 383/907
See application file for complete search history.

(56) References Cited

U.S. PATENT DOCUMENTS 2,289,037 A * 7/1942 Poglein ..... 220/377
3,596,822 A * 8/1971 Holley ..... 220/4.24
3,853,223 A * 12/1974 Nowlain ..... 206/403
4,623,063 A * 11/1986 Balkin ..... 206/408
6,464,077 B1 * 10/2002 Liu ..... 206/388
2004/0089658 A1 * 5/2004 Sarnoff ..... 220/4.24

* cited by examiner

*Primary Examiner*—Jila M. Mohandesi
(74) *Attorney, Agent, or Firm*—Kevin Mark Klughart

(57) ABSTRACT

A rope can system which incorporates storage for lariat, piggin string, gloves, and an integral seating arrangement is disclosed. The disclosed invention is particularly well suited for use in competition rodeo scenarios wherein a cowboy or cowgirl has need for storage of competition materials used in calf roping. The present system permits uniform storage of lariat ropes and the like, as well as the piggin string used for securing the calf. Other accessories such as gloves may also be stored in the water-tight compartments of the disclosed invention. A key feature of the disclosed invention is the incorporation of a seating arrangement to permit the rope can to be used as a resting apparatus while the cowboy/cowgirl waits for their opportunity to compete.

10 Claims, 8 Drawing Sheets

*Prior Art*

*Prior Art*

*Prior Art*

ROPE CAN

CROSS REFERENCE TO RELATED APPLICATIONS

Not Applicable

PARTIAL WAIVER OF COPYRIGHT

All of the material in this patent application is subject to copyright protection under the copyright laws of the United States and of other countries. As of the first effective filing date of the present application, this material is protected as unpublished material.

However, permission to copy this material is hereby granted to the extent that the copyright owner has no objection to the facsimile reproduction by anyone of the patent documentation or patent disclosure, as it appears in the United States Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO A MICROFICHE APPENDIX

Not Applicable

FIELD OF THE INVENTION

The present invention generally relates to rope storage apparatus for articles used in competitive rodeo events, and specifically situations where articles must be temporarily stored for use in competitive calf roping events. The present invention is particularly well suited for application in supporting calf roping rodeo events.

PRIOR ART AND BACKGROUND OF THE INVENTION

Overview (0100, 0200, 0300)

The prior art is generally illustrated in FIG. 1 (0100), FIG. 2 (0200), and FIG. 3 (0300). These will now be discussed in detail.

The prior art teaches a variety of rope retaining means as generally illustrated by U.S. Pat. No. 6,676,061 for ROPE CONTAINER AND METHOD reproduced in FIG. 1 (0100). While these structures are easily constructed they suffer from a practical problem in that they do not adequately protect the lariat rope and also fail to support storage for other articles associated with calf roping events, such as piggin string (the rope used to tie the calf hooves during roping competitions), and leather gloves typically used in these events.

FIG. 2 (0200) illustrates one typical embodiment taught by the prior art in U.S. Pat. No. 5,174,450 for ROPE CONTAINER INSERT in which the rope can does permit storage of the lariat as well as piggin string. However, this system does not permit any other functionality that might be useful in association with calf roping events, such as temporary seating for the event competitor.

FIG. 3 (0300) illustrates a prior art rope as detailed in U.S. Pat. No. 3,997,978 for ROPE CONDITIONING APPARATUS. This construction substantially mimics that of FIG. 2 (0200), but provides an additional compartment which may be used for conditioning rope. This system does not permit separate storage for ancillary items such as piggin string or gloves.

Deficiencies in the Prior Art

The prior art suffers from significant deficiencies, including but not limited to simultaneously providing for storage of the lariat, piggin string, gloves, as well as provisions for temporary seating for the cowboy/cowgirl event competitor.

OBJECTIVES OF THE INVENTION

Accordingly, the objectives of the present invention are (among others) to circumvent the deficiencies in the prior art and affect the following objectives:

(1) Provide for a rope can that can simultaneously provide protective storage for a lariat, piggin string, and gloves.

(2) Provide a rope can that is lightweight and easily transported.

(3) Provide a rope can that can also serve as a temporary seating apparatus for event competitors.

(4) Provide a rope can that is tailored for use in calf roping events.

While these objectives should not be understood to limit the teachings of the present invention, in general these objectives are achieved in part or in whole by the disclosed invention that is discussed in the following sections. One skilled in the art will no doubt be able to select aspects of the present invention as disclosed to affect any combination of the objectives described above.

BRIEF SUMMARY OF THE INVENTION

Overview (0400)

The present invention and typical application is generally illustrated in FIG. 4 (0400) wherein a preferred exemplary embodiment of the present invention rope can (0401) may be used by a cowboy (0402) or other rodeo competitor as a temporary seating apparatus that rests on the ground (0403) or other surface.

General Construction (0500)

The present invention system can be generally illustrated by the preferred exemplary embodiment construction overview illustrated by the perspective diagram of FIG. 5 (0500). The basic elements of the present invention generally include the following:

A major can shell (0501) and minor can shell (0502) which mate to form an airtight rigid structure having a cylindrical inner compartment used for storing a lariat and other accessories necessary for calf roping competitions.

First (0503) and second (0504) seating platforms formed at opposite sides of the cylindrical sides of the major and minor can shells. These seating platforms provide a mechanism for the rope can to be placed on the ground or other flat surface for the purposes of providing a seat for the cowboy/cowgirl while awaiting their turn at rodeo competition.

One or more latching clasps (0505) used to secure the major can shell to the minor can shell. A preferred embodiment of the present invention as illustrated in FIG. 5 (0500) utilizes a conventional metal clasp fixed to the major can shell (0501) that is mated to a molded insert in the minor can shell (0502). The number of latching clasps (0505) may vary widely based on a variety of construction preferences.

A handle (0506) attached to the outer cylindrical wall of the major can shell (0501) for the purpose of carrying the rope can.

Further details of this general construction (and associated storage facilities within the rope can are illustrated in the sectional view of FIG. 8 (0800).

BRIEF DESCRIPTION OF THE DRAWINGS

For a fuller understanding of the advantages provided by the invention, reference should be made to the following detailed description together with the accompanying drawings wherein.

DESCRIPTION OF THE PRESENTLY PREFERRED EXEMPLARY EMBODIMENTS

Figure 1:
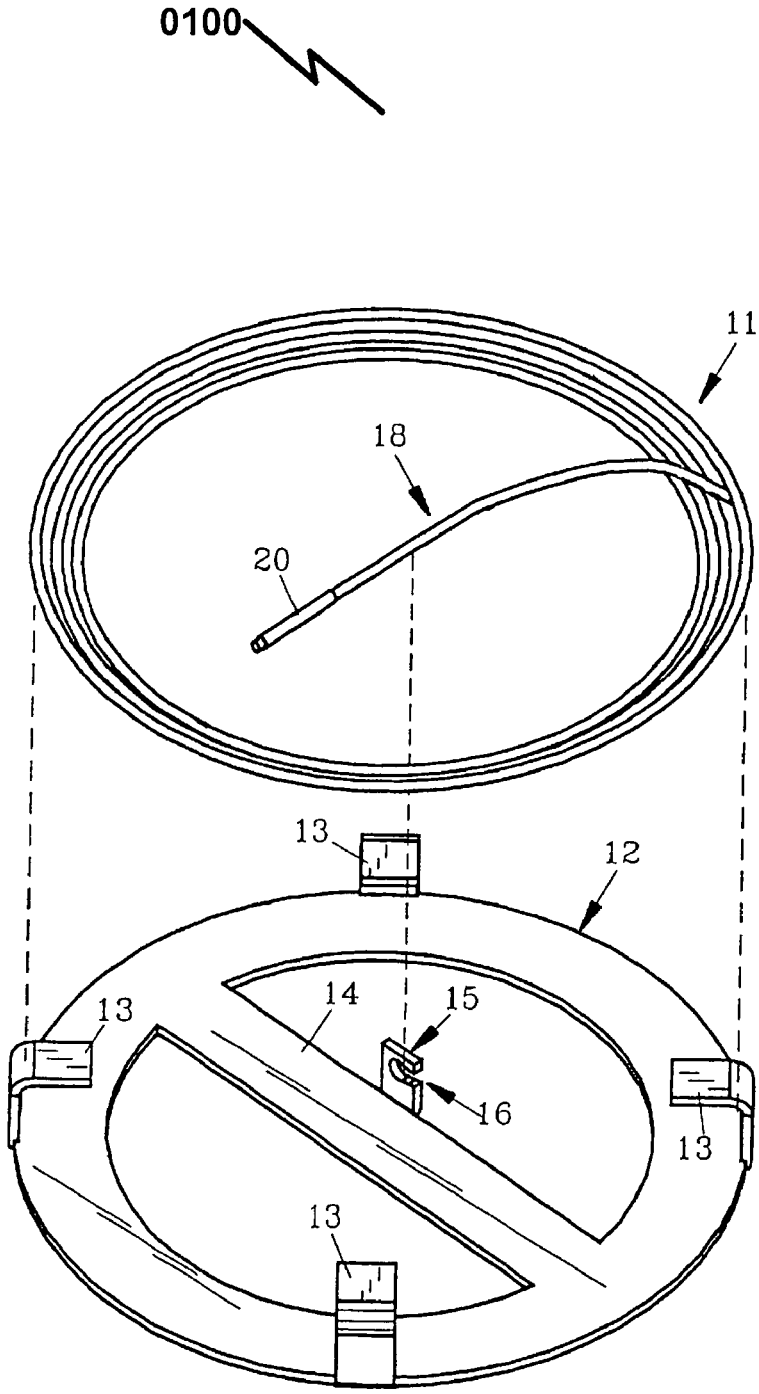
FIG. 1 illustrates a prior art rope containment system as detailed in U.S. Pat. No. 6,676,061 for ROPE CONTAINER AND METHOD.
Figure 2:
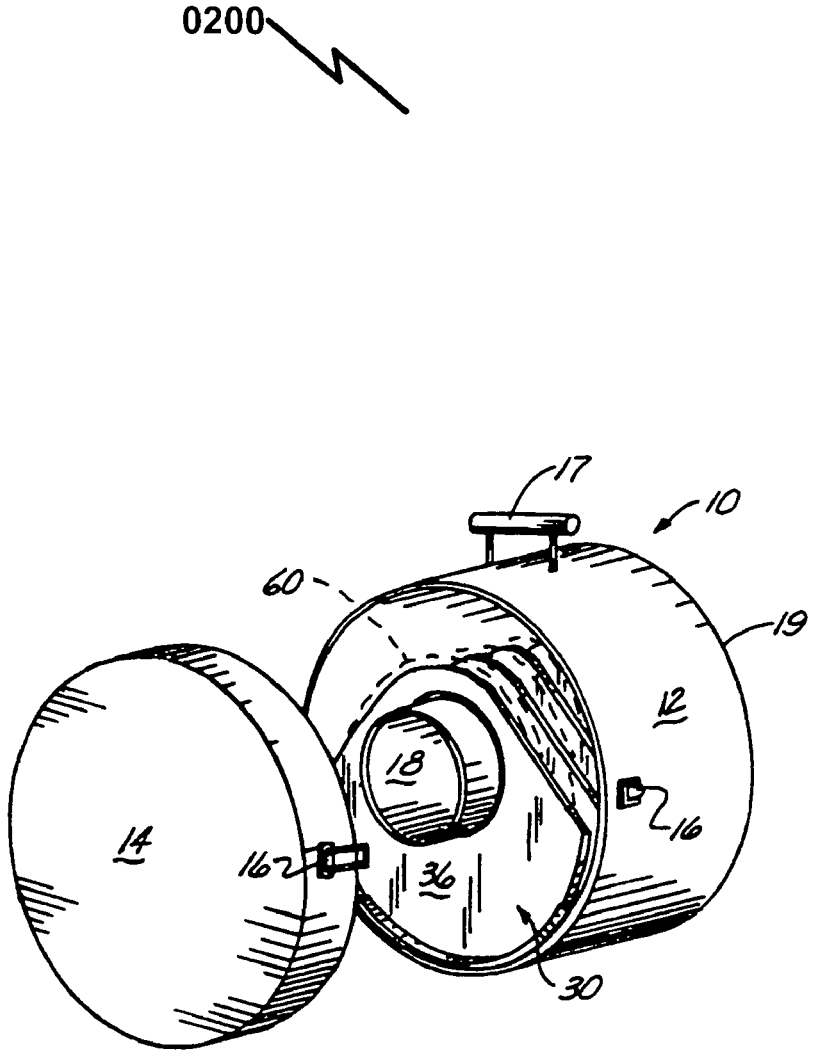
FIG. 2 illustrates a prior art rope containment system as detailed in U.S. Pat. No. 5,174,450 for ROPE CONTAINER INSERT.
Figure 3:
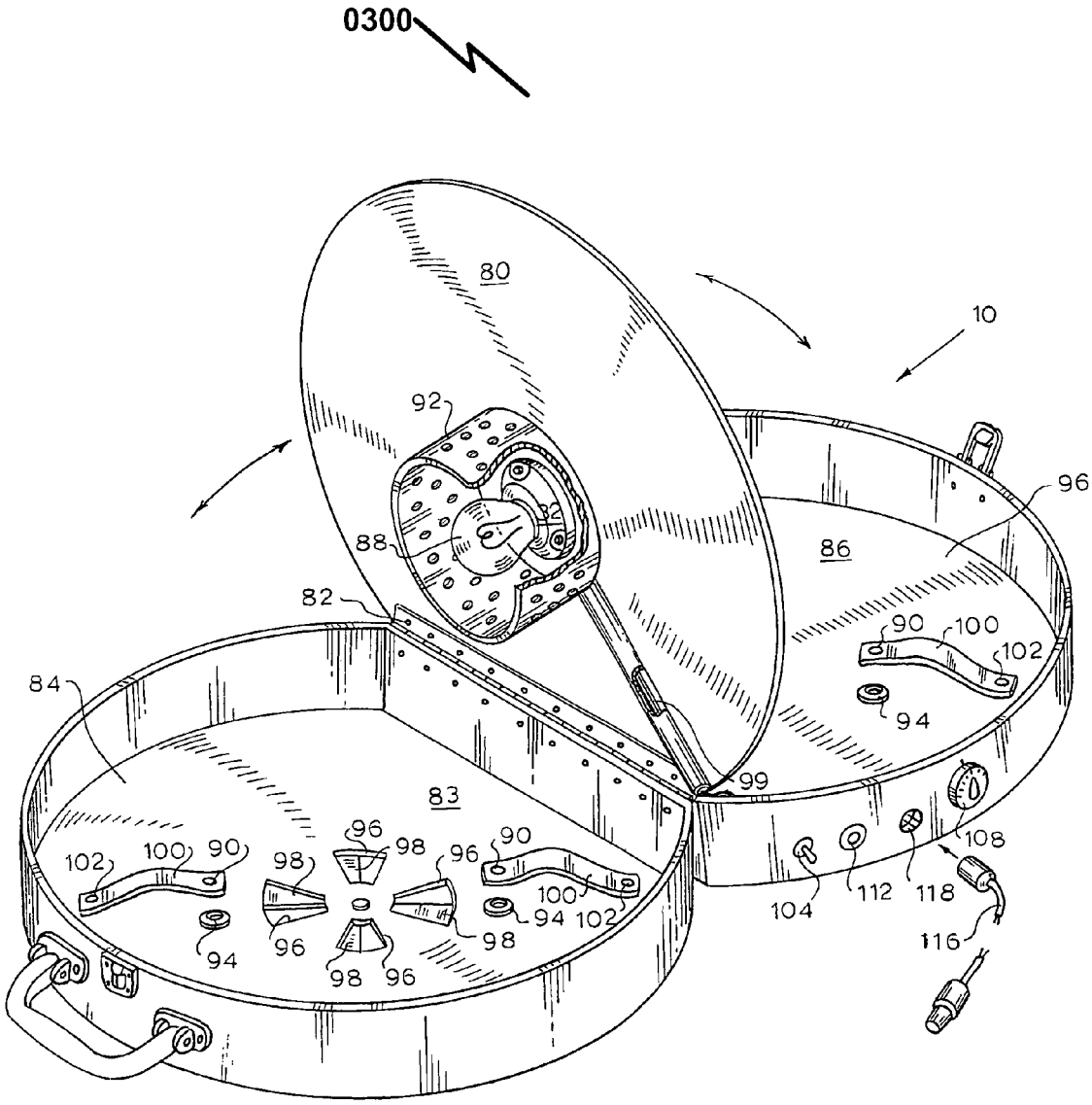
FIG. 3 illustrates a prior art rope containment system as detailed in U.S. Pat. No. 3,997,978 for ROPE CONDITIONING APPARATUS.

While this invention is susceptible of embodiment in many different forms, there is shown in the drawings and will herein be described in detailed preferred embodiment of the invention with the understanding that the present disclosure is to be considered as an exemplification of the principles of the invention and is not intended to limit the broad aspect of the invention to the embodiment illustrated.

The numerous innovative teachings of the present application will be described with particular reference to the presently preferred embodiment, wherein these innovative teachings are advantageously applied to the particular problems of a ROPE CAN. However, it should be understood that this embodiment is only one example of the many advantageous uses of the innovative teachings herein. In general, statements made in the specification of the present application do not necessarily limit any of the various claimed inventions. Moreover, some statements may apply to some inventive features but not to others.

Materials Not Limitive

The present invention may be constructed of a variety of materials, including but not limited to plastic, metal, wood, etc. The general construction illustrated herein is not intended to limit the scope of materials suitable for this application. One skilled in the art will recognize that the system may be constructed of a wide variety of materials without departing from the scope of the invention as taught herein.

Figure 4:
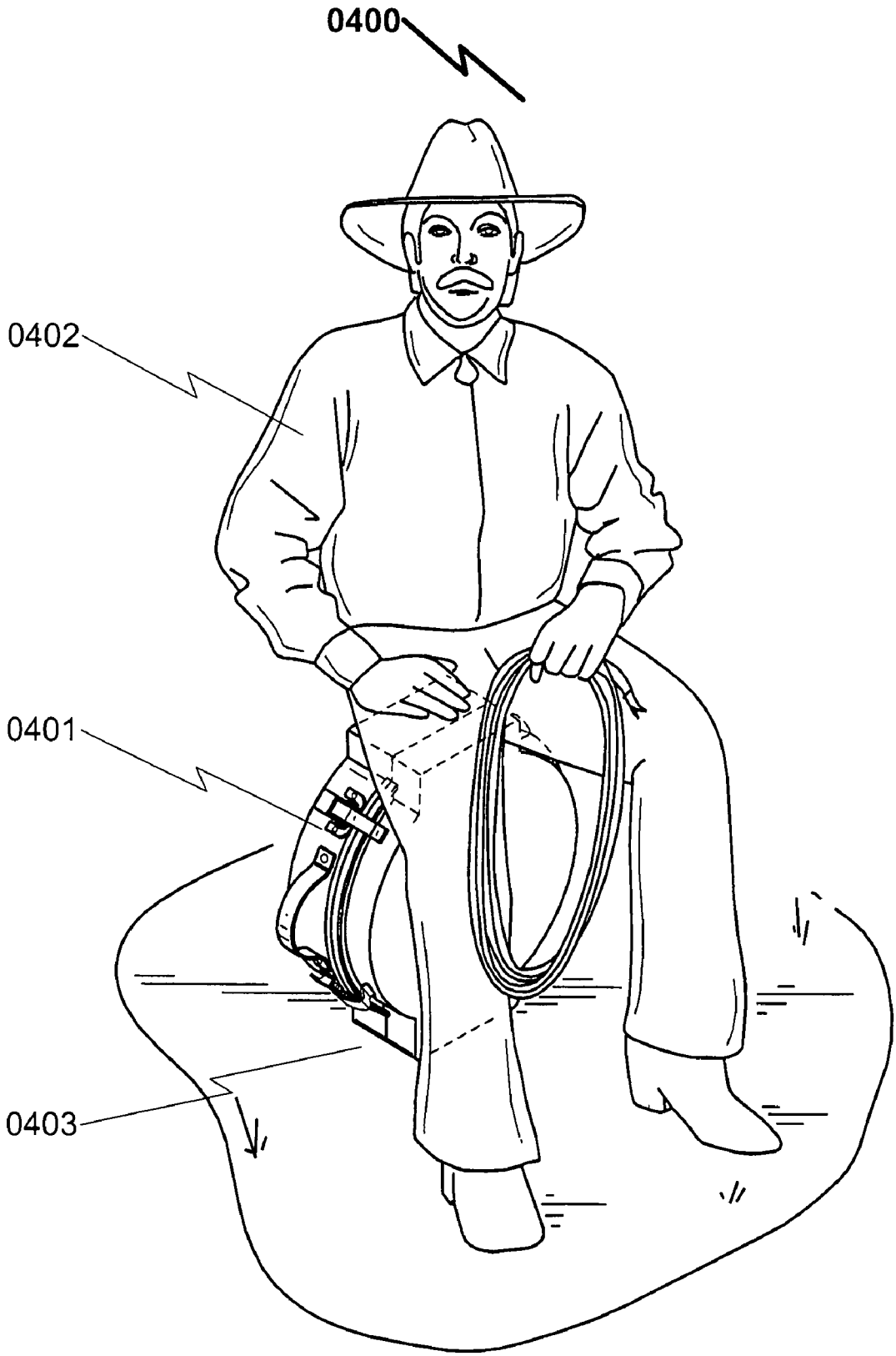
FIG. 4 illustrates a preferred exemplary embodiment of the present invention as applied to use as a temporary seating arrangement for competitive calf roping or other rodeo events.
Figure 5:
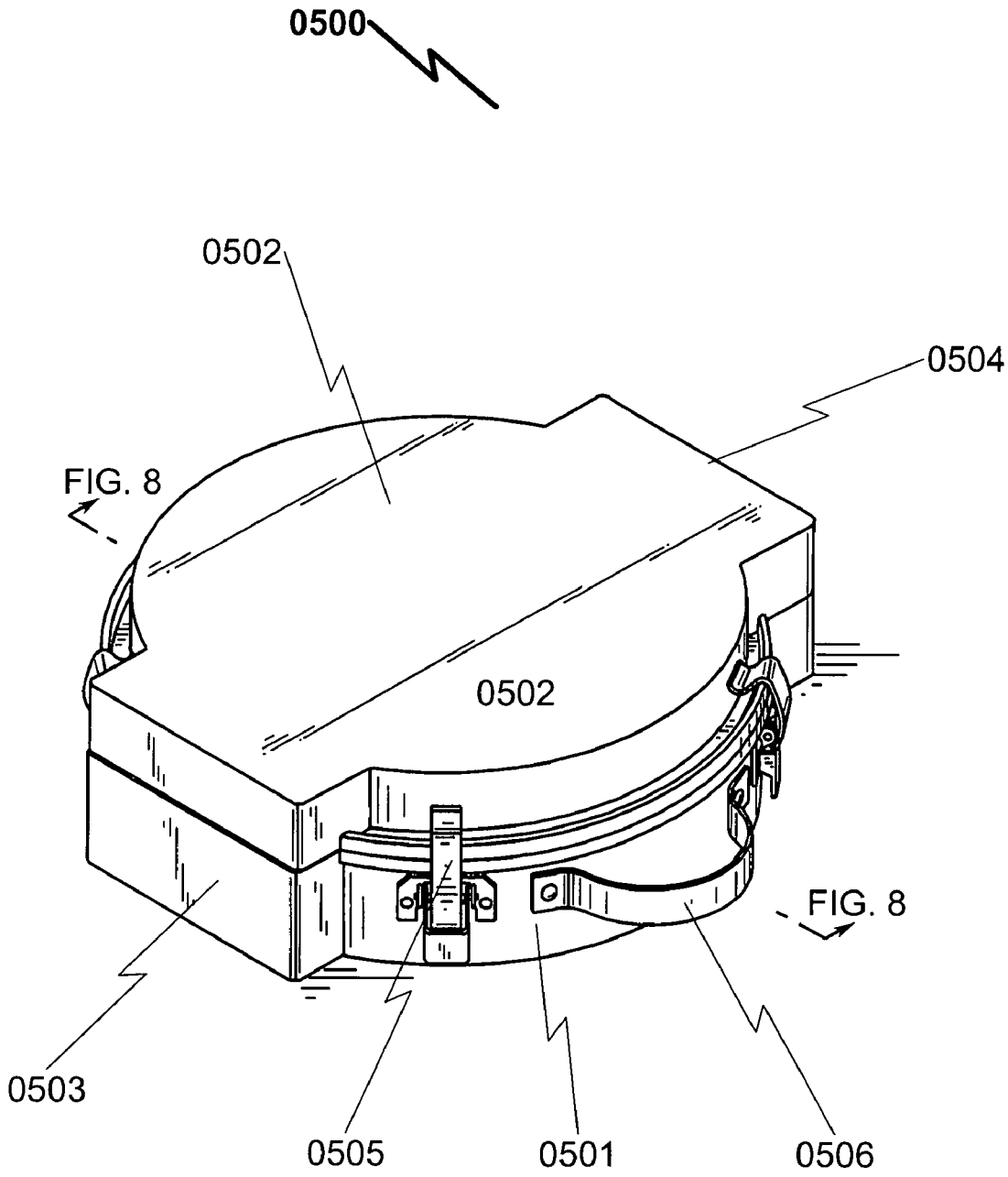
FIG. 5 illustrates a perspective view of a preferred exemplary embodiment of the present invention.

The preferred exemplary embodiments illustrated herein are generally constructed using an injection molded plastic fabrication technique. The preferred embodiment utilizes plastic as the primary construction material, as this material is easily fabricated, resistant to moisture, easily sealed, and possesses the strength necessary to support a cowboy in a seating configuration as seen in FIG. 4 (0400).

Exemplary Construction (0600)

Figure 6:
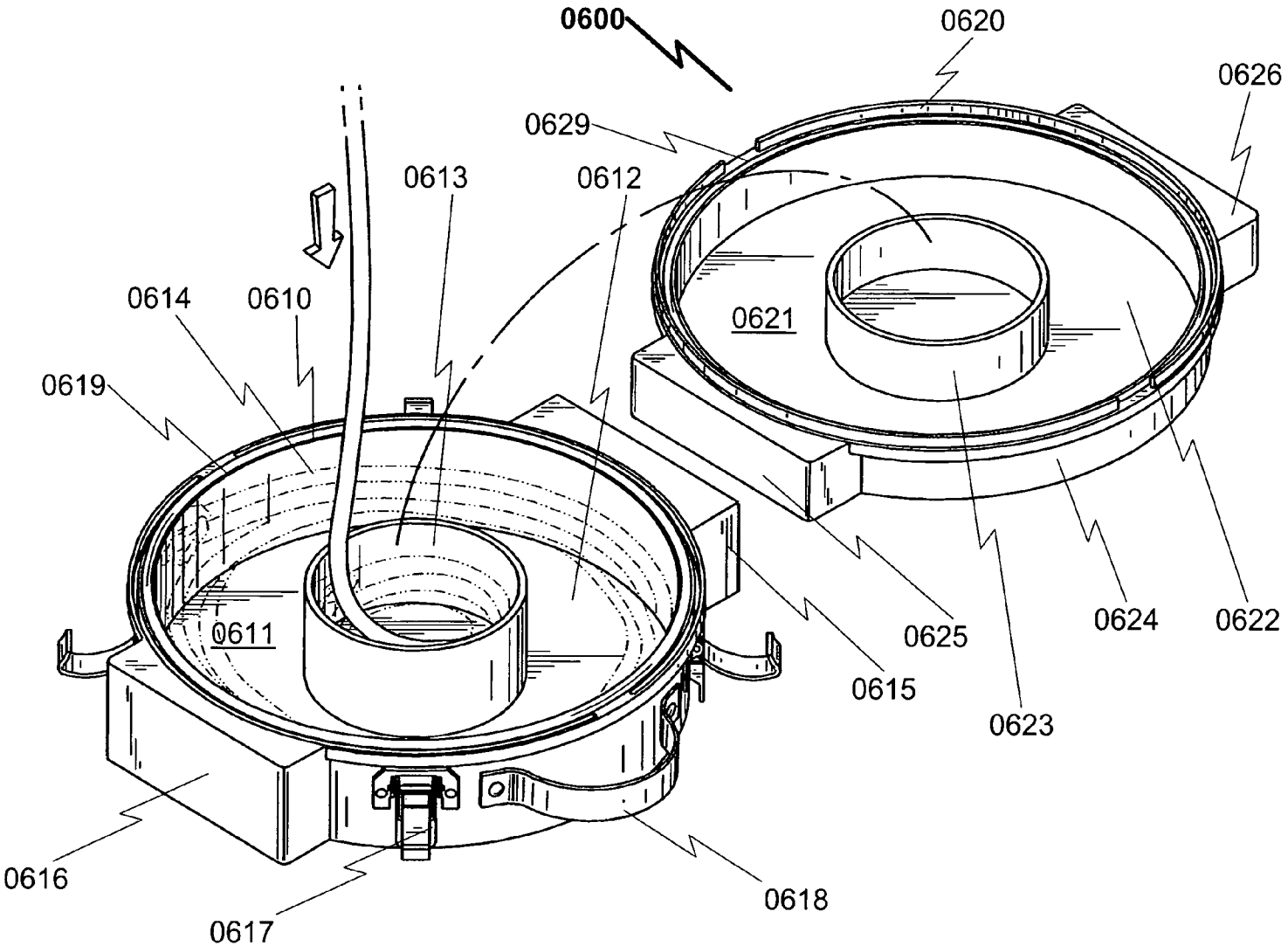
FIG. 6 illustrates a perspective view of a preferred exemplary embodiment of the present invention detailing assembly of the two-piece rope can system.

The present invention can be generally illustrated by the preferred exemplary embodiment illustrated by the perspective assembly view of FIG. 6 (0600). The elements of the present invention generally include the following:

Major can shell (0611) comprising a substantially flat bottom (0612), major cylindrical inner cylinder (0613), major cylindrical outer cylinder (0614), first (0615) and second (0616) major rectangular seating platforms located on opposite sides of said major cylindrical outer cylinder (0614);

Minor can shell (0621) comprising a substantially flat bottom (0622), minor cylindrical inner cylinder (0623), minor cylindrical outer cylinder (0614), first (0625) and second (0626) minor rectangular seating platforms located on opposite sides of said minor cylindrical outer cylinder (0624);

Latching clasps (0617) attached to the major can shell which mate to corresponding detents in the minor can shell for the purposes of permitting the major and minor can shells to be mated together in an airtight configuration;

Alignment detents (0629) in the minor can shell (0621) outer lip and corresponding alignment tangs (0619) in the major can shell (0611) outer lip to permit alignment and locking of the major and minor can shells when mated together;

Optional carrying handle (0618) to permit transportation of the rope can. This carrying handle may be fabricated using a variety of materials. However, many preferred embodiments utilize leather as the handle material;

An optional rubber gasket seal (0610) may be incorporated within the major can shell outer lip to permit an airtight seal to be achieved when the major can shell is mated to the corresponding seal lip (0620) in the minor can shell.

This exemplary construction overcomes the deficiencies in the prior art by providing an airtight container for competition rodeo ropes and calf roping competitions while simultaneously permitting the cowboy/cowgirl to use the container as a comfortable seating arrangement while waiting for their turn at competition.

Sectional Assembly View (0700)

Figure 7:
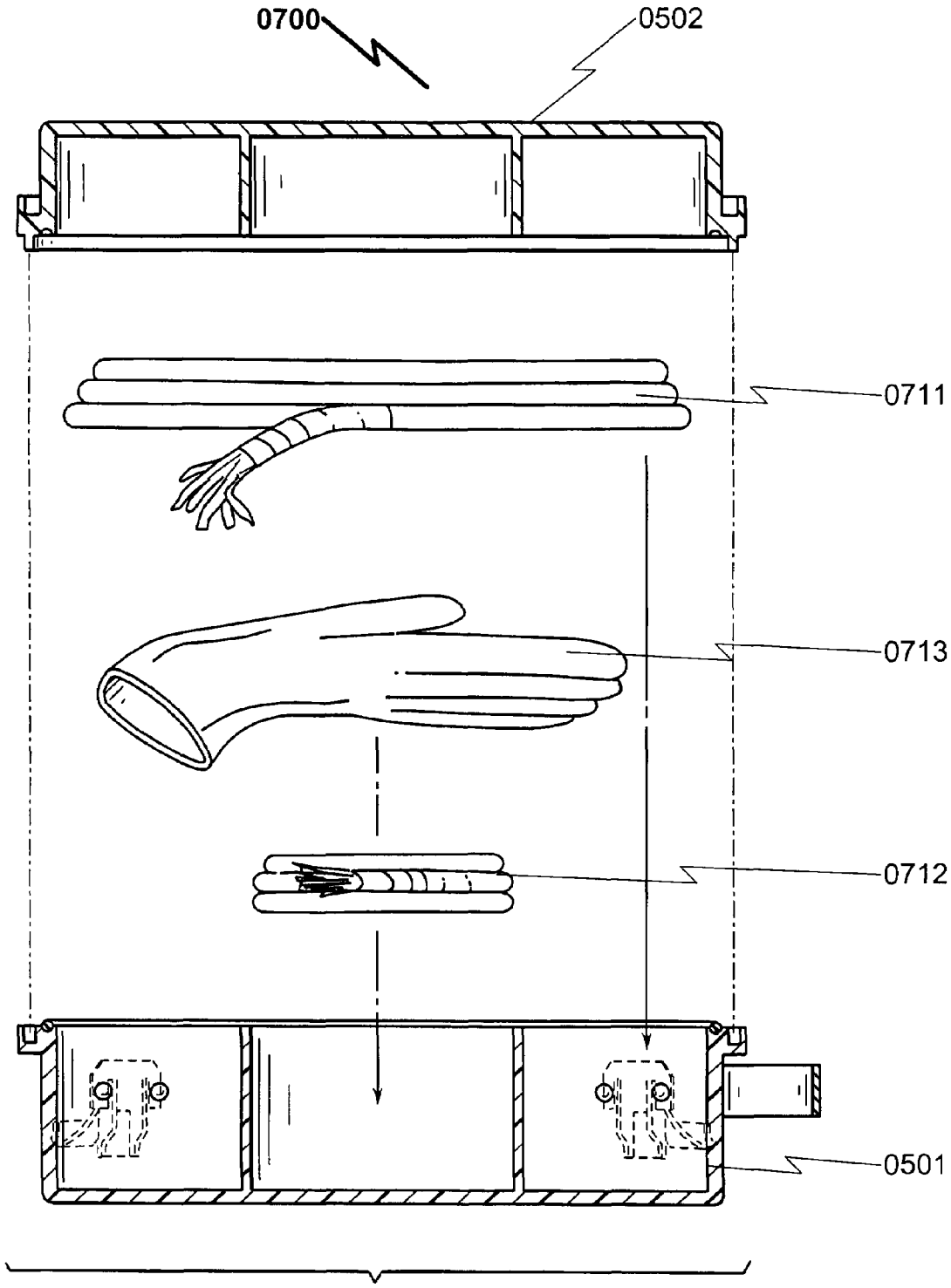
FIG. 7 illustrates a sectional assembly view of a preferred exemplary embodiment of the present invention detailing storage of lariat, piggin string, and gloves.

As illustrated in the sectional assembly view of FIG. 7 (0700), the major can shell (0501) and the minor can shell (0502) mate together in an airtight configuration, with compartmentalized space for the rope lariat (0711), piggin string (0712), gloves (0713), and other accessories associated with competitive rodeo events.

One skilled in the art will recognize that additional compartments may be incorporated within the scope of the rope can as illustrated without departing from the spirit of the invention as taught herein.

Sectional Assembled View (0800)

Figure 8:
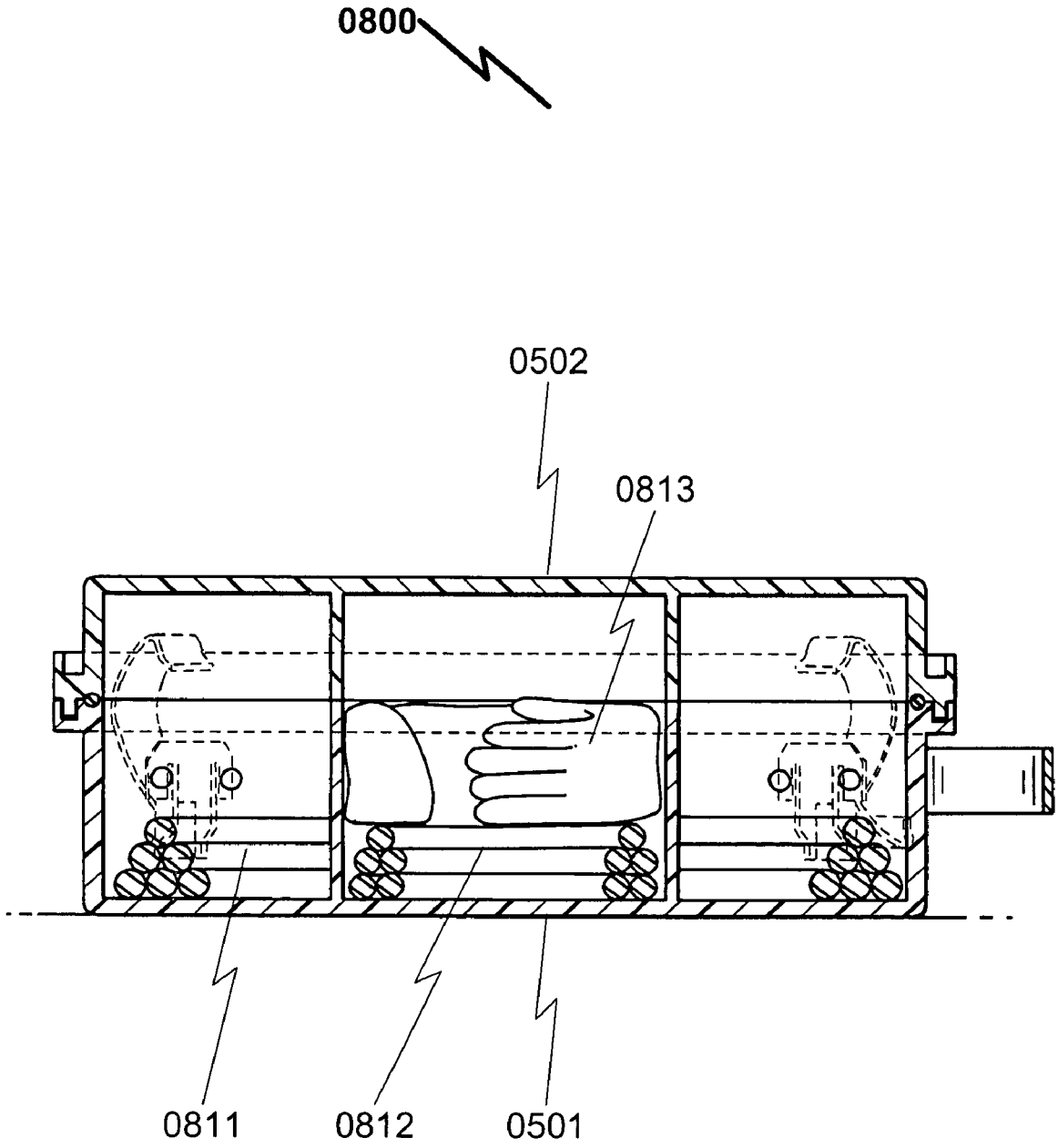
FIG. 8 illustrates a sectional assembled view of a preferred exemplary embodiment of the present invention detailing storage of lariat, piggin string, and gloves.

As illustrated in the sectional assembled view of FIG. 8 (0800), the present invention permits the major can shell (0501) and the minor can shell (0502) to mate together in an airtight configuration, with compartmentalized space for the rope lariat (0811), piggin string (0812), gloves (0813), and other accessories associated with competitive rodeo events.

One skilled in the art will recognize that additional compartments may be incorporated within the scope of the rope can as illustrated without departing from the spirit of the invention as taught herein.

System Variations

The present invention anticipates a wide variety of variations in the basic theme of construction. The examples presented previously do not represent the entire scope of possible usages. They are meant to cite a few of the almost limitless possibilities.

CONCLUSION

A rope can system which incorporates storage for lariat, piggin string, gloves, and an integral seating arrangement has been disclosed. The disclosed invention is particularly well suited for use in competition rodeo scenarios wherein a cowboy or cowgirl has need for storage of competition materials used in calf roping. The present system permits uniform storage of lariat ropes and the like, as well as the piggin string used for securing the calf. Other accessories such as gloves may also be stored in the water-tight compartments of the disclosed invention. A key feature of the disclosed invention is the incorporation of a seating arrangement to permit the rope can to be used as a resting apparatus while the cowboy/cowgirl waits for their opportunity to compete.

What is claimed is:

1. A rope can system comprising:

(a) Major can shell comprising a flat bottom, major cylindrical inner cylinder, major cylindrical outer cylinder, first and second major rectangular seating platforms located on opposite sides of said major cylindrical outer cylinder; and (b) Minor can shell comprising a flat bottom, minor cylindrical inner cylinder, minor cylindrical outer cylinder, first and second minor rectangular seating platforms located on opposite sides of said minor cylindrical outer cylinder;

wherein the first and second major rectangular seating platforms and the first and second minor rectangular seating platforms permit the rope can system to function as a seating platform for an individual;

said major cylindrical outer cylinder further comprises latching clasps which mate to detents in said minor cylindrical outer cylinder;

said major can shell and said minor can shell mate together to form an airtight container; and said major can shell and said minor can shell mate together such that said first and second major rectangular seating platforms and said first and second minor rectangular seating platforms form a seat.

2. The rope can system of claim 1 further comprising a carrying handle attached to the outer surface of said major cylindrical outer cylinder.

3. The rope can system of claim 1 further comprising a leather carrying handle attached to the outer surface of said major cylindrical outer cylinder.

4. The rope can system of claim 1 wherein said major cylindrical outer cylinder further comprises an alignment tang which mates to a corresponding alignment detent in said minor cylindrical outer cylinder.

5. The rope can system of claim 1 wherein said major cylindrical outer cylinder further comprises an outer lip incorporating a rubber gasket seal.

6. The rope can system of claim 1 wherein said minor cylindrical outer cylinder further comprises a sealing lip corresponding to and mating with a rubber gasket seal in said major cylindrical outer cylinder.

7. The rope can system of claim 1 wherein said major cylindrical outer cylinder further comprises plastic.

8. The rope can system of claim 1 wherein said minor cylindrical outer cylinder further comprises plastic.

9. The rope can system of claim 1 wherein said major cylindrical outer cylinder further comprises four latching clasps.

10. The rope can system of claim 1 wherein said major and said minor cylindrical outer cylinders form storage for a lariat and said major and said minor cylindrical inner cylinders form storage for a piggin string.

* * * * *